US012733759B2

(12) United States Patent
Choi

(10) Patent No.: US 12,733,759 B2
(45) Date of Patent: Sep. 15, 2026

(54) CERVICAL PILLOW

(71) Applicant: Bun Hee Choi, Coquitlam (CA)

(72) Inventor: Bun Hee Choi, Coquitlam (CA)

( * ) Notice: Subject to any disclaimer, the term of this patent is extended or adjusted under 35 U.S.C. 154(b) by 0 days.

(21) Appl. No.: 19/028,703

(22) Filed: Jan. 17, 2025

(65) Prior Publication Data

US 2025/0344885 A1 Nov. 13, 2025

(30) Foreign Application Priority Data

May 10, 2024 (KR) ..... 10-2024-0061902

(51) Int. Cl.
*A47G 9/10* (2006.01)

(52) U.S. Cl.
CPC ..... *A47G 9/109* (2013.01); *A47G 2009/1018* (2013.01)

(58) Field of Classification Search
CPC ... A47G 9/10; A47G 9/109; A47G 2009/1018
See application file for complete search history.

(56) References Cited

U.S. PATENT DOCUMENTS 3,276,046 A * 10/1966 Capelli ..... A47G 9/10 5/639
5,138,732 A * 8/1992 Wattie ..... A47G 9/10 5/636
5,781,947 A * 7/1998 Sramek ..... A47G 9/109 5/636
7,203,983 B1 * 4/2007 Reeves ..... A47G 9/109 5/639
7,461,421 B1 * 12/2008 Faircloth ..... A47G 9/1045 5/639
8,161,588 B1 * 4/2012 Anson ..... A47G 9/109 5/636
9,167,924 B2 * 10/2015 Chen ..... A47G 9/109
D795,611 S * 8/2017 Dickholtz, Jr. ..... D6/601
D869,196 S * 12/2019 Shin ..... D6/601
D898,429 S * 10/2020 Huang ..... D6/601
D923,972 S * 7/2021 Ou ..... D6/601
(Continued)

FOREIGN PATENT DOCUMENTS

CN 102188128 A * 9/2011
JP 3239974 U * 11/2022
(Continued)

*Primary Examiner* — David E Sosnowski
(74) *Attorney, Agent, or Firm* — KORUS Patent, LLC; Seong Il Jeong

(57) ABSTRACT

Proposed is a cervical pillow that allows the user's cervical spine to have a lordotic curve while lying in a supine position, while ensuring a comfortable sleep as the structure of the pillow does not interfere with the natural tossing and turning that occurs during sleep. To this end, the cervical pillow includes a pillow body consisting of a supine posture support part, and a side-lying posture support part that extends in each direction from the supine posture support part, and made of a material with elasticity and resilience, wherein the supine posture support part is formed such that the upper surface thereof is flush with the upper surface of the side-lying posture support part, and has an alignment guide groove recessed upward on the bottom surface corresponding to the upper surface part where the head and neck of a user lying in the supine position are supported.

2 Claims, 6 Drawing Sheets

(56) References Cited

U.S. PATENT DOCUMENTS

| | | | | | |
|---|---|---|---|---|---|
| D997,603 | S | * | 9/2023 | Ke | A47G 9/109 D6/601 |
| D1,025,659 | S | * | 5/2024 | Peng | D6/601 |
| D1,109,550 | S | * | 1/2026 | Mann | D6/601 |
| 2005/0150051 | A1 | * | 7/2005 | Greenawalt | A47G 9/10 5/636 |
| 2008/0134438 | A1 | * | 6/2008 | Park | A47G 9/10 5/636 |
| 2008/0271247 | A1 | * | 11/2008 | Kogan | A47G 9/109 5/636 |
| 2011/0094033 | A1 | * | 4/2011 | Lee | A47G 9/109 5/636 |
| 2014/0026323 | A1 | * | 1/2014 | Bowers | A47G 9/109 5/636 |
| 2014/0033438 | A1 | * | 2/2014 | Chen | A47G 9/109 5/636 |
| 2014/0317852 | A1 | * | 10/2014 | Chen | A47G 9/109 5/644 |
| 2016/0073801 | A1 | * | 3/2016 | Shin | A47G 9/1045 5/636 |
| 2019/0069698 | A1 | * | 3/2019 | Lin | A47G 9/1009 |
| 2020/0268183 | A1 | * | 8/2020 | Murphy | A47G 9/109 |
| 2020/0375382 | A1 | * | 12/2020 | Park | A47G 9/109 |
| 2021/0037996 | A1 | * | 2/2021 | Liu | A47G 9/1054 |
| 2021/0298499 | A1 | * | 9/2021 | Kim | A61F 7/02 |
| 2022/0000289 | A1 | * | 1/2022 | Ho | A47G 9/109 |
| 2022/0142384 | A1 | * | 5/2022 | Norstrem | A47G 9/1081 |
| 2022/0183484 | A1 | * | 6/2022 | Park | A47G 9/109 |
| 2024/0023734 | A1 | * | 1/2024 | Kitson | A47G 9/1081 |

FOREIGN PATENT DOCUMENTS

| | | | | | |
|---|---|---|---|---|---|
| KR | 20-0418726 | Y1 | | 6/2006 | |
| KR | 10-1312256 | B1 | | 9/2013 | |
| KR | 101381423 | B1 | * | 4/2014 | A47G 9/10 |
| KR | 1434817 | B1 | * | 8/2014 | |
| KR | 10-2018-0009618 | A | | 1/2018 | |
| KR | 20200032549 | A | * | 3/2020 | A47G 9/109 |
| KR | 102471213 | B1 | * | 11/2022 | A47G 9/1081 |
| KR | 10-2024-0034369 | A | | 3/2024 | |
| KR | 20240034369 | A | * | 3/2024 | A47G 9/109 |
| WO | WO-2025234663 | A1 | * | 11/2025 | A47G 9/1081 |

* cited by examiner

CERVICAL PILLOW

CROSS-REFERENCE TO RELATED APPLICATION

This application claims priority to Korean Application No. 10-2024-0061902, filed May 10, 2024, the entire contents of which is incorporated herein for all purposes by this reference.

BACKGROUND

Technical Field

The present disclosure relates to a cervical pillow and, more particularly, to a cervical pillow that helps to maintain a natural curvature of the cervical spine and ensures a comfortable sleep.

Description of the Related Art

In general, pillows are used to support the head and neck of a user to aid sleeping when the user lies down. Recently, various functional pillows intended to increase sleep quality and enable the correct sleeping posture have been introduced. Among the functional pillows, there is a cervical pillow designed in a way that supports the neck and head and allows the supported neck to conform to the natural lordotic curve.

Many people use cervical pillows because it is known that the cervical pillows may reduce tension in the neck and shoulders and relieve headaches or neck pain by supporting the neck area so as to inhibit fatigue of the neck muscles, and improve breathing by dilating the bronchi and airways. In most cervical pillows, the part where the head is supported is concave and the part where the neck is supported is convex and protruding.

However, the concave and convex parts of the upper surface of such a pillow to support the user's head and neck only function as a cervical pillow when a user lies flat on his/her back (supine position) without movement, and those concave and convex parts are, in fact, a factor that interferes with the user's natural tossing and turning during sleep, thereby aggravating the user's tossing and turning. In addition, in conventional cervical pillows, the part that supports the neck is designed to conform to the natural curvature of the cervical spine, but is excessively high, causing the user's chin to be lifted and the top of the head to face the floor, which may interrupt comfortable breathing. Moreover, the part that supports the neck may actually cause pain as the part supports the hard and rigid occipital muscles. A user who lies down on a pillow, especially on a flat part of the pillow formed on each side of a concave part configured to support the head of the user lying supine is bound to experience misalignment of the cervical spine because the neck area is not supported.

Document of Related Art (Patent Document 1) Korean Patent Application Publication No. 10-2024-0034369, "CERVICAL ALIGNMENT PILLOW"

SUMMARY

Accordingly, the present disclosure has been made keeping in mind the above problems occurring in the related art, and the present disclosure is intended to provide a cervical pillow that encourages the cervical spine of a user to form a natural curvature while the user lies in a supine position, and ensures a comfortable sleep as the structure of the pillow does not interfere with tossing and turning that generally occurs during sleep.

In addition, an objective of the present disclosure is to provide a cervical pillow that aligns the cervical spine by supporting the neck along with the head of a user in the side lying position.

In order to achieve the above objectives, according to an aspect of the present disclosure, there is provided a cervical pillow including a pillow body including: a supine posture support part; and a side-lying posture support part configured to extend in each direction from the supine posture support part, and made of a material with elasticity and resilience, wherein the supine posture support part may be provided such that an upper surface thereof may be flush with an upper surface of the side-lying posture support part, and may have an alignment guide groove recessed upward on a bottom surface corresponding to an upper surface part where a head and a neck of a user lying in a supine position are supported.

In addition, the alignment guide groove may include: a first alignment guide part configured to be depressed by the head of the user lying in the supine position; and a second alignment guide part recessed to have a lower height than the first alignment guide part and configured to be depressed by the neck of the user lying in the supine position.

In addition, the first alignment guide part may be shaped like a square horn, and the second alignment guide part may have a left-right width of a bottom that is same as a left-right width of a bottom of the first alignment guide part, and a left-right width of a top that is larger than a left-right width of a top of the first alignment guide part.

In addition, the cervical pillow may further include a depression control pad configured to have a plate shape with a height lower than that of the first alignment guide part, and provided within the first alignment guide part.

In addition, a back side of the pillow body located near a shoulder of the lying user may form a convex curve toward a front side so that a user's shoulder line may be adjacent when viewed from top, and may have a curved surface that protrudes backward from bottom to top so that an upper end of the back side of the pillow body may fit around an upper side of the shoulder.

According to the present disclosure, since an alignment guidance groove is pressed due to the load of the head and neck of a user lying supine, causing natural depression on the upper surface of a supine posture support part, even if tossing and turning occurs during sleeping while maintaining the supine posture, the user's head and neck are stably supported, and thus the user can sleep comfortably.

In addition, due to the difference in the degree to which a first alignment guidance part and a second alignment guidance part depress, the neck can be fitted around and supported so that the cervical spine is aligned, and the cervical spine can have a lordotic curve. Additionally, due to the rear structure of a pillow body A, the user's entire head and neck can be stably supported not only when lying in the supine position but also in the side lying position.

Furthermore, by adjusting the degree of depression of the alignment guidance groove using a depression control pad, it is possible to achieve an appropriate depression level for each individual user.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION

In the present disclosure, proposed is a cervical pillow that allows the user's cervical spine to have a lordotic curve while lying in a supine position, while ensuring comfortable sleep as the structure of the pillow does not interfere with the natural tossing and turning that occurs during sleep. To this end, the cervical pillow includes a pillow body consisting of: a supine posture support part; and a side-lying posture support part that extends in each direction from the supine posture support part, and made of a material with elasticity and resilience, wherein the supine posture support part is formed such that the upper surface thereof is flush with the upper surface of the side-lying posture support part, and has an alignment guide groove recessed upward on the bottom surface corresponding to the upper surface part where the head and neck of a user lying in the supine position are supported.

The scope of the present disclosure is not limited to the embodiments described below, and various modifications may be made by those skilled in the art without departing from the technical gist of the present disclosure.

Hereinafter, a cervical pillow of the present disclosure will be described in detail with reference to the attached FIGS. 1 to 9B.

As shown in FIGS. 1 to 4, the cervical pillow of the present disclosure includes a pillow body A on which a user lies while sleeping or resting, and the pillow body A consists of a supine posture support part 100 that supports the head and neck of a user when the user lies in a supine position; and a side-lying posture support part 200 that extends in each direction from the supine posture support part 100 to support the head and neck when the user is in a side lying position.

The pillow body A is made of a material with elasticity and resilience, so that a depression occurs due to the load of the user's head and neck, and the user's head and neck are firmly supported and may return to the original state thereof when the load is removed. As an example, the pillow body A may be made of polyurethane material, but is preferably made of latex material, which is more supportive and offers superior durability, breathability, and safety compared to memory foam.

Hereinafter, in describing the present disclosure, the height direction of the pillow body A is referred to as the vertical direction, the length direction of the pillow body A is referred to as the lateral direction, and the width direction of the pillow body A is referred to as the front-back (front-rear) direction.

Figure 1:
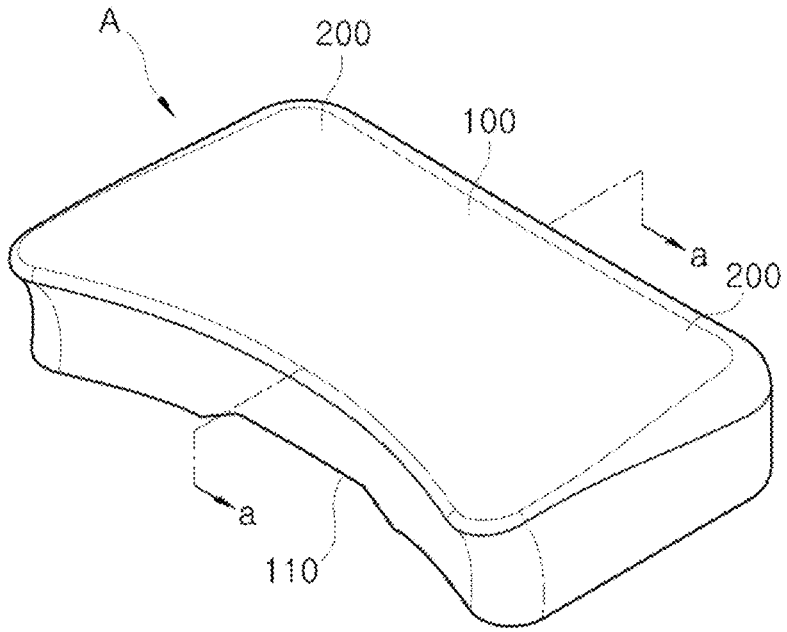
FIG. 1 is a perspective view showing a cervical pillow of the present disclosure.
Figure 2:
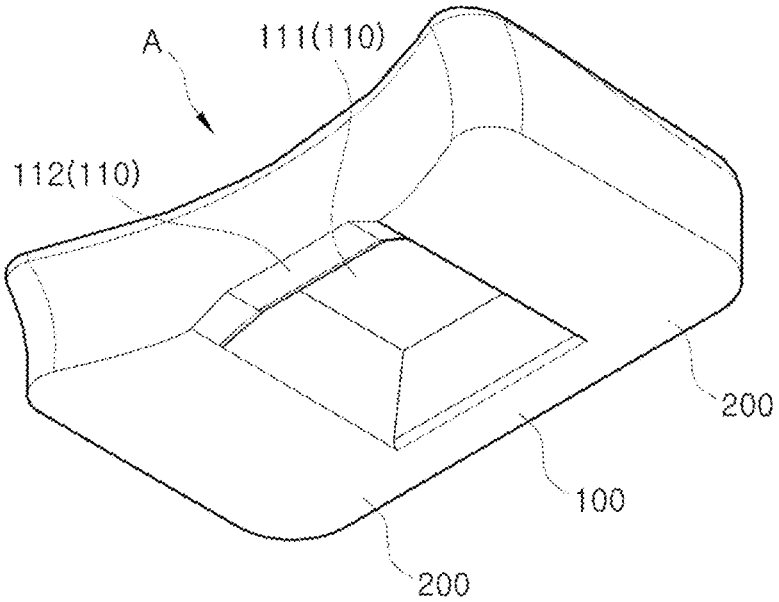
FIG. 2 is a rear perspective view showing the cervical pillow of the present disclosure.
Figure 3:
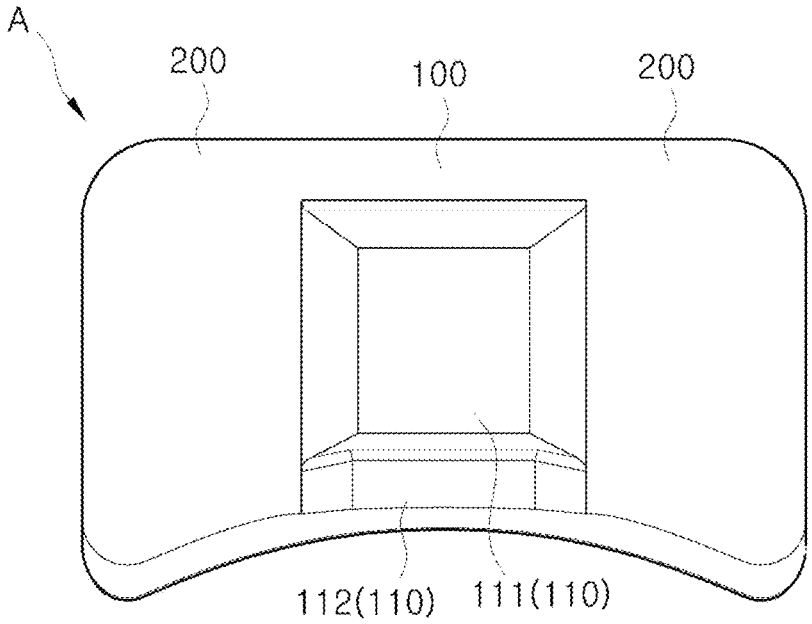
FIG. 3 is a bottom view showing the cervical pillow of the present disclosure.
Figure 4:
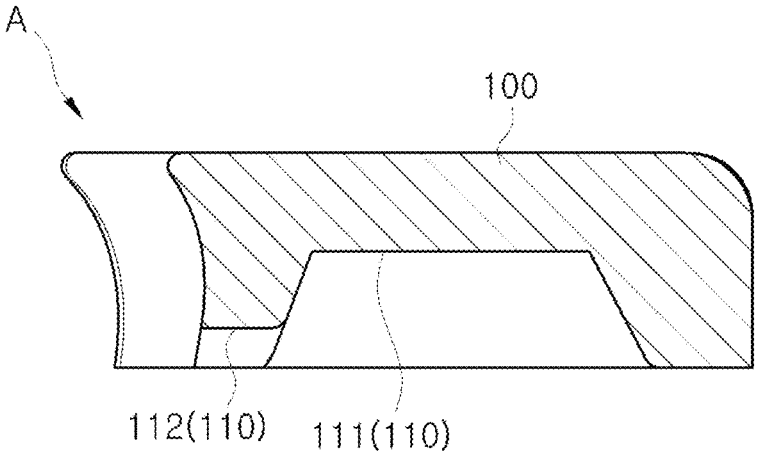
FIG. 4 is a cross-sectional view showing the a-a cross section in FIG. 1.
Figure 5A:
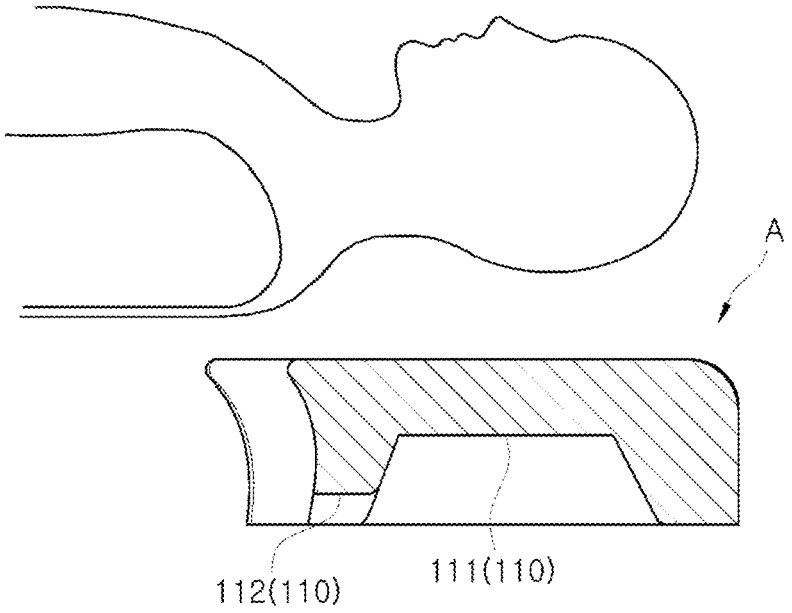
FIGS. 5A and 5B are cross-sectional views showing the deformation of an alignment guidance groove of the cervical pillow of the present disclosure when a user lies supine on the pillow.
Figure 5B:
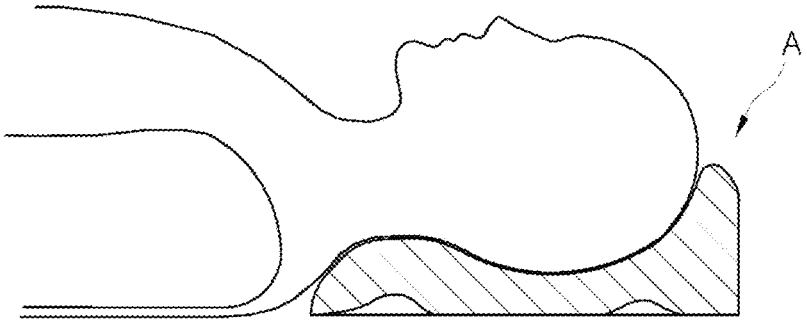

The supine posture support part 100 is formed such that the upper surface thereof is flush with the upper surface of the side-lying posture support part 200 as shown in FIG. 1, and has an alignment guide groove 110 recessed upward on the bottom surface corresponding to the upper surface part where the head and neck of a user lying in the supine position are supported as shown in FIGS. 2 to 4. As shown in FIGS. 5A and 5B, when the user lies in the supine position and the head and neck of the user are placed on the supine posture support part 100, due to the load of the user's head and neck, the alignment guide groove 110 is pressed and the upper surface of the supine posture support part 100 is naturally depressed, causing part of the user's head and neck buried between the side-lying posture support parts 200 respectively located on opposite sides of the supine posture support part 100.

In this way, as the upper surface of the supine posture support part 100 is naturally depressed, even if the user whose head and neck are supported by the supine posture support part 100 tosses and turns during sleeping while maintaining the supine posture, only the most depressed point in the supine posture support part 100 changes slightly as the user tosses and turns, the user's 30 head and neck are stably supported, and thus the user may sleep comfortably.

As shown in FIGS. 2 to 4, the alignment guide groove 110 may include: a first alignment guide part 111 configured to be depressed by the head of the user lying in the supine position; and a second alignment guide part 112 configured to be depressed by the neck of the user lying in the supine position. The first alignment guide part 111 is formed as the central portion of the bottom of the supine posture support part 100 is recessed upward, and the second alignment guide part 112 is formed as the rear end of the bottom of the supine posture support part 100 is recessed upward. At this time, it is preferable that the second alignment guide part 112 is recessed to have a lower height than the first alignment guide part 111.

Accordingly, the supine posture support part 100 is formed such that the thickness from the upper surface to the top of the second alignment guide part 112 is greater than the thickness from the upper surface to the top of the first alignment guide part 111. Due to this, the degree of depression of the upper surface of the supine posture support part 100 corresponding to the second alignment guide part 112 is relatively less than the degree of depression of the upper surface of the supine posture support part 100 corresponding to the first alignment guide part 111, and thus the cervical spine of the user lying in the supine posture may have a lordotic curve.

As an example, the first alignment guide part 111 may be formed in a cylindrical or polygonal cylinder shape, but is preferably recessed to form a cone shape to promote natural depression and provide stable support even when the user tosses and turns. To be specific, when considering the shape of the user's head and a structure that facilitates natural connection with the second alignment guide part 112, it is more preferable for the first alignment guide part 111 to be in the shape of a square horn as shown in FIGS. 2 to 4. At this time, it is preferable that the second alignment guide part 112 has a left-right width of the bottom that is the same as the left-right width of the bottom of the first alignment guide part 111, and a left-right width of the top that is larger than the left-right width of the top of the first alignment guide part 111, so as to easily fit around and support the neck so that the cervical spine is aligned.

Figure 6:
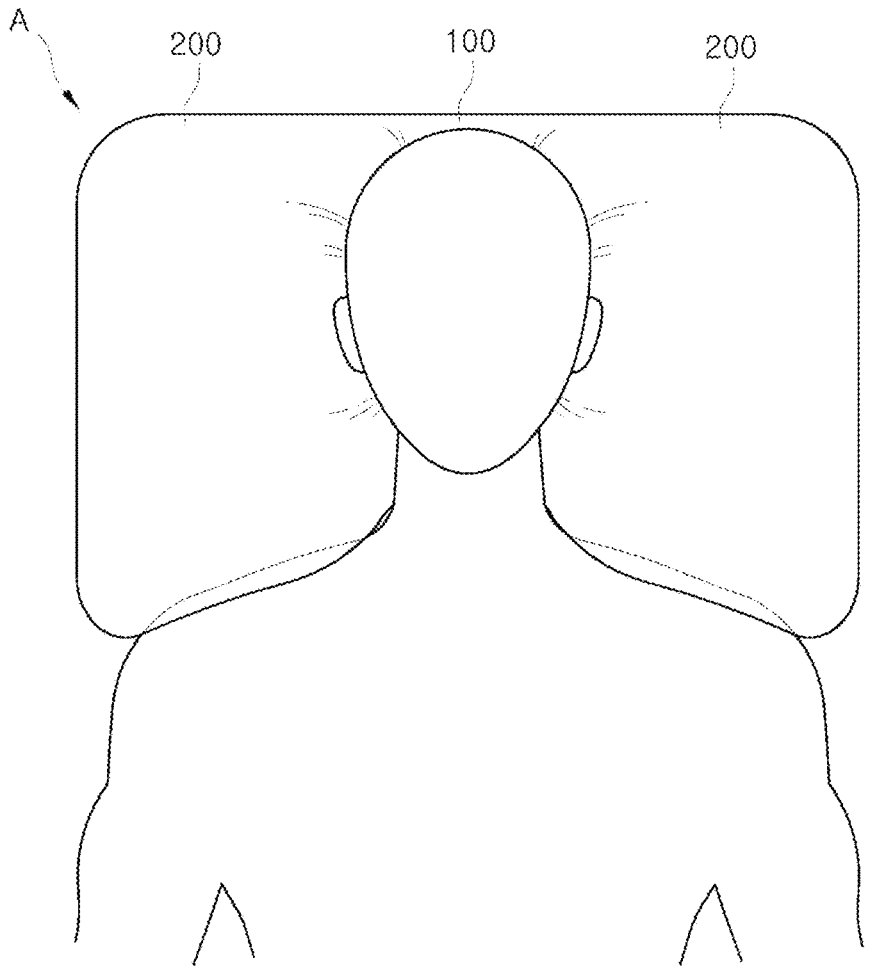
FIG. 6 is a plan view showing a state in which a user is lying supine on the cervical pillow of the present disclosure.
Figure 8:
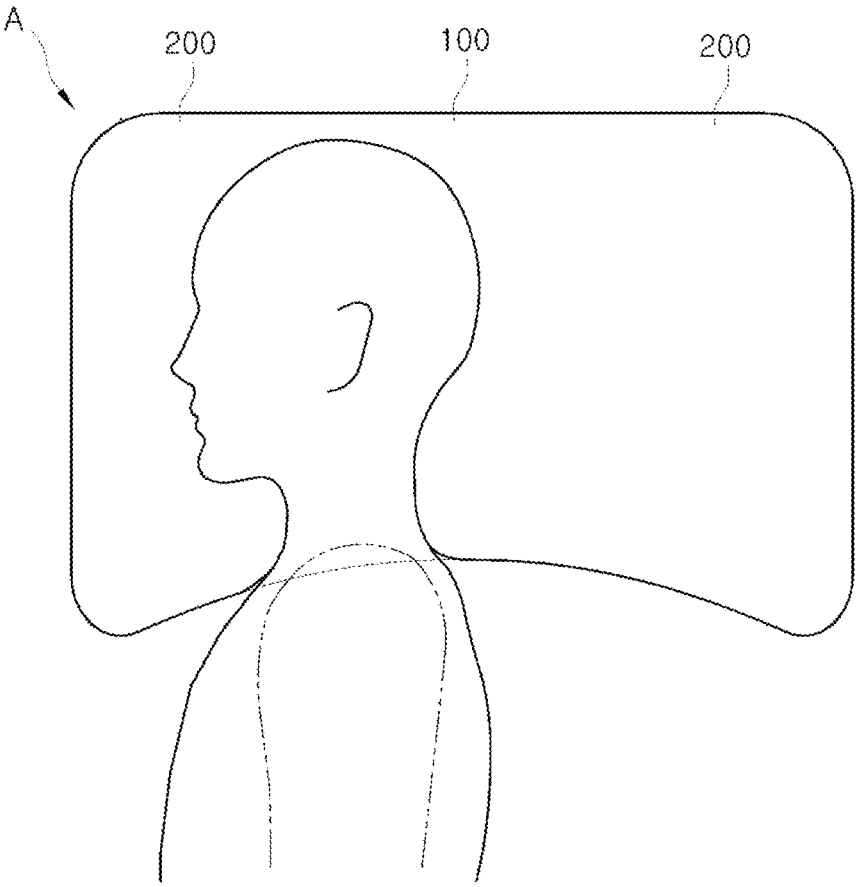
FIG. 8 is a plan view showing a state in which a user is lying sideways on the cervical pillow of the present disclosure.

In addition, the pillow body A of the present disclosure may be configured to support both the head and neck not only when the user lies supine but also when the user lies sideways. To this end, the back side of the pillow body A located near the shoulder of the lying user may form a convex curve toward the front side so that the user's shoulder line is adjacent as shown in FIG. 6 when viewed from top. That is, the side-lying posture support part 200 may be formed to have a front-back width longer than the front-back width of the supine posture support part 100, and may be formed to become longer as the distance from the supine posture support part 100 increases. This is to ensure that not only the temporal region of the side of the user's head but also the entire side of the neck is supported so that the cervical spine is aligned even if the user lies in the side lying posture using the side-lying posture support part 200 as shown in FIG. 8.

Figure 7:
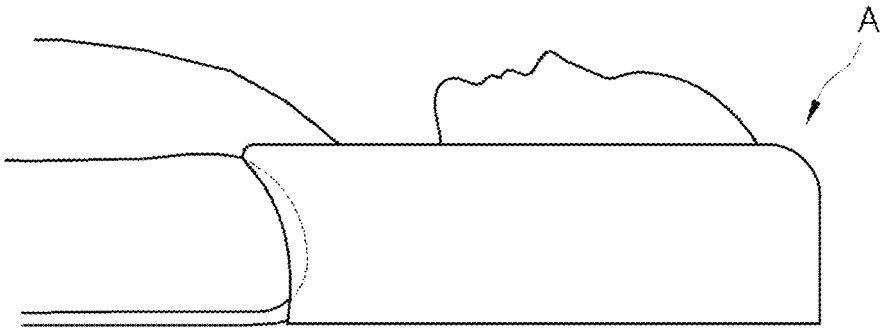
FIG. 7 is a side view showing a state in which a user is lying supine on the cervical pillow of the present disclosure.

Additionally, the back side of the pillow body A may form a curved surface that protrudes backward from the bottom to the top, as shown in FIG. 7. Accordingly, as shown in FIGS. 6 and 7, when the user lies in the supine position, the upper end of the back side of the pillow body A cradles the entire shoulder of the user from the upper side, thereby inhibiting the pillow body A from being twisted due to tossing and turning of the user during sleep, and helping to maintain the lordotic curve of the cervical spine more effectively. In addition, as shown in FIG. 8, when the user lies in the side lying position, the user's shoulder, which is located below, is cradled around the neck due to the curved surface that forms the back side of the pillow body A, and the space between the user's chin and shoulder is tightly filled by the pillow, so that the entire cervical spine may be aligned.

Figure 9A:
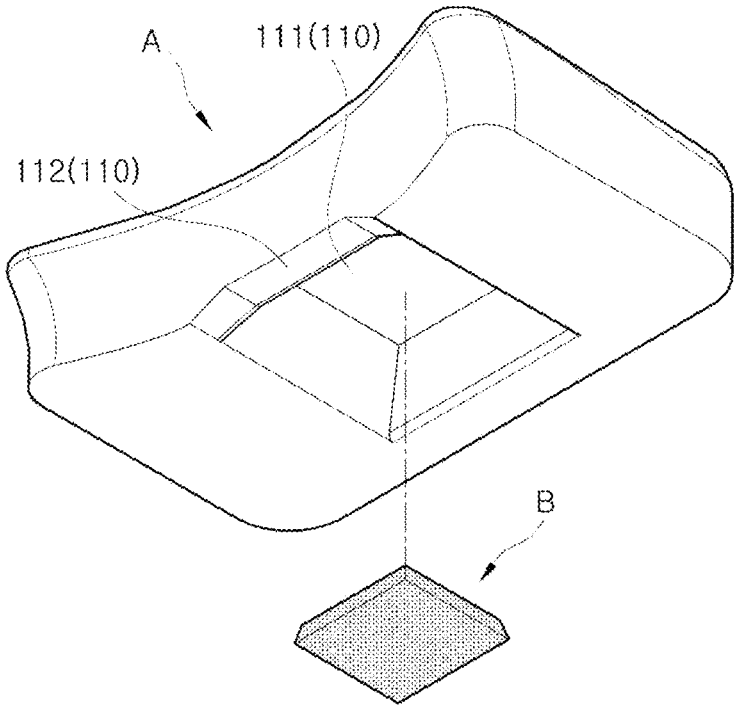
FIGS. 9A and 9B are examples showing that a depression control pad may be provided in the alignment guidance groove of the cervical pillow of the present disclosure.
Figure 9B:
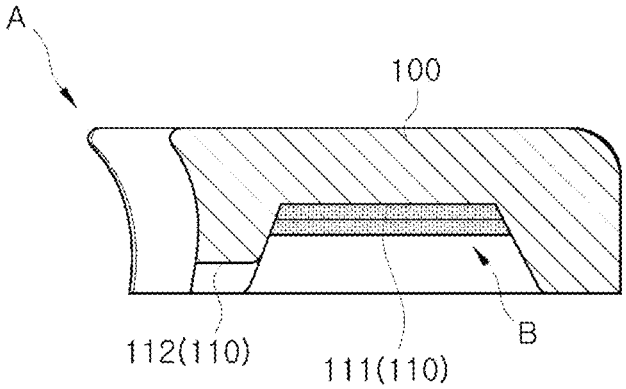

Meanwhile, since each user has different body type, head shape, cervical spine condition, and preferred sleeping position, the present disclosure may further include a depression control pad B configured to control depression. The depression control pad B, like the pillow body A, may be made of a material with elasticity and resilience, and as shown in FIGS. 9A and 9B, may have a plate shape with a height lower than that of the first alignment guide part 111 and may be provided within the first alignment guide part 111. The depression control pad B may be detachable from the pillow body A, and may be configured as a plurality of the pads, with the pads being detachable from each other.

As an example, the depression control pad B may be provided in a plural number by dividing a square horn having the same size and shape as the first alignment guide part 111 into pieces at every predetermined height. At this time, except for the depression control pad B, which may be located at the lowermost side of the first alignment guide part 111, the remaining depression control pads B may be provided with Velcro on the upper and lower surfaces thereof, and the depression control pad B, which may be located at the lowermost side of the first alignment guide part 111, may be provided with Velcro on the upper surface thereof. In addition, at the top of the first alignment guide part 111, Velcro may be provided for attachment to and detachment from the depression control pad B, which may be located at the uppermost side.

Therefore, the user is able to adjust the number of depression control pads B attached within the first alignment guide part 111 to produce an appropriate level of depression to ensure comfortable sleep and alignment of the cervical spine.

What is claimed is:

1. A cervical pillow comprising:

a pillow body (A) including: a supine posture support part (100); and a side-lying posture support part (200) configured to extend in each direction from the supine posture support part (100), and made of a material with elasticity and resilience, wherein the supine posture support part (100) is provided such that an upper surface thereof is flush with an upper surface of the side-lying posture support part (200), and has an alignment guide groove (110) recessed upward on a bottom surface corresponding to an upper surface part configured to support a head and a neck of a user lying in a supine position, wherein the alignment guide groove (110) comprises:

a first alignment guide part (111) configured to be depressed by a head of a user lying in the supine position; and a second alignment guide part (112) recessed to have a lower height than the first alignment guide part (111) and configured to be depressed by a neck of the user lying in the supine position, wherein the first alignment guide part (111) is shaped like a square horn, and wherein a bottom of the second alignment guide part (112) has a left-right width that is same as a left-right width of a bottom of the first alignment guide part (111), and a left-right width of a top of the second alignment guide part (112) is larger than a left-right width of a top of the first alignment guide part (111).

2. The cervical pillow of claim 1, wherein a back side of the pillow body (A) configured to be positioned near a shoulder of a user lying on the pillow forms a convex curve toward a front side so that a shoulder line of the user is adjacent thereto when viewed from above, and has a curved surface that protrudes backward from bottom to top so that an upper end of the back side of the pillow body (A) is configured to fit around an upper side of the shoulder.

* * * * *